US005727492A

United States Patent [19]

Cuneo et al.

[11] Patent Number: 5,727,492

[45] Date of Patent: Mar. 17, 1998

[54] LIQUEFIED NATURAL GAS TANK AND CONTAINMENT SYSTEM

[75] Inventors: Joseph J. Cuneo, Hastings on Hudson, N.Y.; Robert D. Goldbach, Milford, Pa.; Neil M. Miller, Ramsey, N.J.; Edmund G. Tornay, Folly Beach, S.C.

[73] Assignee: Marinex International Inc., Hoboken, N.J.

[21] Appl. No.: 710,333

[22] Filed: Sep. 16, 1996

[51] Int. Cl.[6] ..... B63B 25/08

[52] U.S. Cl. ..... 114/74 A; 220/445; 220/901

[58] Field of Search ..... 114/74 RT, 74 A; 220/445, 901

[56] References Cited

U.S. PATENT DOCUMENTS

| | | | |
|---|---|---|---|
| 735,637 | 8/1903 | Whittelsey . | |
| 886,621 | 5/1908 | Mehrtens . | |
| 1,253,645 | 1/1918 | Taylor . | |
| 1,605,513 | 11/1926 | Connery . | |
| 2,330,022 | 9/1943 | Baier | 114/79 |
| 3,191,792 | 6/1965 | Hunt | 220/445 |
| 3,640,237 | 2/1972 | Phelps | 114/16 R |
| 3,766,875 | 10/1973 | Baki | 114/73 |
| 3,851,611 | 12/1974 | Yamamoto | 114/74 A |
| 3,899,988 | 8/1975 | Menendez | 114/74 A |
| 4,128,069 | 12/1978 | Kotcharian | 114/74 A |
| 4,170,952 | 10/1979 | McCown | 114/74 A |
| 4,173,936 | 11/1979 | Secord et al. | 114/74 A |
| 4,199,909 | 4/1980 | Kotcharian | 52/410 |
| 4,452,162 | 6/1984 | Harbaugh | 114/74 A |
| 4,548,154 | 10/1985 | Murata et al. | 114/355 |
| 4,573,422 | 3/1986 | Murata et al. | 114/65 R |
| 4,638,754 | 1/1987 | Tornay | 114/79 R |
| 4,660,491 | 4/1987 | Murata et al. | 114/65 R |
| 5,085,161 | 2/1992 | Cuneo et al. | 114/65 R |
| 5,086,723 | 2/1992 | Goldbach et al. | 114/78 |
| 5,090,351 | 2/1992 | Goldbach et al. | 114/65 R |
| 5,263,428 | 11/1993 | Mo | 114/65 A |
| 5,269,246 | 12/1993 | Goldbach et al. | 114/45 |
| 5,293,830 | 3/1994 | Goldbach | 114/65 R |
| 5,313,903 | 5/1994 | Goldbach et al. | 114/65 R |
| 5,320,055 | 6/1994 | Goldbach | 114/65 R |
| 5,359,953 | 11/1994 | Skaarup et al. | 114/74 A |
| 5,456,198 | 10/1995 | Smedal et al. | 114/65 R |
| 5,477,797 | 12/1995 | Stuart | 114/65 R |

FOREIGN PATENT DOCUMENTS

| | | | |
|---|---|---|---|
| 0 635 424 A1 | 1/1995 | European Pat. Off. | B63B 9/06 |
| 0 688 714 A1 | 12/1995 | European Pat. Off. | B63B 25/08 |
| 2 239 488 | 7/1991 | United Kingdom | B63H 25/22 |

*Primary Examiner*—Jesus D. Sotelo
*Attorney, Agent, or Firm*—Fish & Richardson P.C.

[57] ABSTRACT

Liquid cargo tank and support system suitable for liquified natural gas, LNG, for LNG cargo ships includes a semi-membrane tank having vertical walls constructed of a series of curved plates and a girder support system that permits access to the tank exterior.

20 Claims, 7 Drawing Sheets

LIQUEFIED NATURAL GAS TANK AND CONTAINMENT SYSTEM

This invention relates to cargo tanks for liquified natural gas (LNG).

BACKGROUND OF THE INVENTION

Vessels designed to carry liquified natural gas (LNG) are among the most expensive commercial cargo carrying vessels in the world. This is due to both the relatively light weight of LNG, having a specific gravity of less than 0.5 and therefore requiring a relatively large volume capacity for a given weight of cargo, and the extremely low temperature required to keep the LNG in its liquid state under sufficiently low pressures required to enable long at-sea transit in commercially viable quantities. LNG is not transported in pressure tanks at relatively high temperature. LNG is transported at a very slight positive vapor pressure above atmospheric pressure and at its boiling temperature of approximately minus 260 degrees Fahrenheit (minus 160 degrees Celsius). All containment systems must be constructed of materials which can withstand the extremely low temperatures and designed to accommodate the wide temperature changes from ambient (as built) conditions to in-service conditions and to provide effective temperature insulation to prevent heat inflow and unacceptable cooling of the vessel's basic hull structure. Each of the containment systems currently in use addresses these criteria in different ways, often utilizing different materials. State-of-the-art containment systems for carrying liquified natural gas (LNG) aboard sea-going vessels are generally described in either of two categories: independent tanks, which are generally self-supporting and which rely only upon foundations to transmit the gravitational and other forces of their weight and the weight of their contents to the surrounding hull structure, and which are therefore capable of being placed within the cargo holds at a distance separate from the hull structure; and "membrane tanks," by which we mean tanks that rely entirely upon the surrounding hull structure to maintain their shape and integrity and to absorb all of the hydrostatic forces imposed by their contents and which must therefore be in intimate contact with the surrounding hull structure at virtually all points.

The primary material used in all LNG containment systems is considerably more costly than conventional shipbuilding steels. Independent tanks are generally constructed of aluminum alloy, although 9% nickel steel and stainless steel are also acceptable materials. Independent tanks are sufficiently robust to independently withstand the hydrostatic and hydrodynamic forces and to transmit these forces to the surrounding hull structure through their foundation support system and to accommodate thermally induced stresses caused by the temperature difference between ambient and LNG cargo service temperatures. Membrane containment systems are generally constructed of either stainless steel or Invar, a high nickel content alloy with minimal thermal expansion characteristics. These materials, while substantially more costly per unit weight than the aluminum alloy of typical independent tanks, can be designed into competitive systems owing to the relative thinness and resulting light weight of the membrane, which cannot independently withstand the forces encountered and relies on a load-bearing insulation system to transmit forces to the hull structure. Typically, independent tanks require far greater quantities of aluminum alloy than membrane systems require of either stainless steel or Invar. The load-bearing thermal insulation for membrane containment systems must be capable of transmitting the hydrostatic and hydrodynamic loads to the hull structure. Load-bearing insulation systems for membrane tanks are generally more complex and more costly than the thermal insulation systems installed with independent tanks.

Independent tank systems, being separate from the hull structure, typically are designed with sufficient space between the containment system (tank plus insulation) and the hull structure to allow human access for inspection, maintenance and repair of the outer surface of the insulation and the inner surface of the vessel's double hull structure. Membrane containment systems, being in intimate contact with the hull structure, do not permit such access and, therefore, make the inspection of either the insulation system or the inner hull structure far more difficult and expensive to accomplish.

The several designs that have found acceptance incorporate relatively expensive materials suitable for low temperature (cryogenic) applications, and they attempt to achieve economic competitiveness through a balance of quantity of material versus material price, complexity of design and labor intensity required for both the hull and the containment (tank and insulation) system. The impact on the construction of the surrounding vessel hull is also a major factor in determining the total economic viability of any LNG containment system for application in ship construction.

The prevailing design for LNG cargo tanks in the world market is free-standing spherical tanks. Typically, four or five large spherical tanks are placed in line in a ship, each supported by a cylinder or circular ring that is in turn supported by the bottom of the ship's hull. Spherical tanks have achieved Type B status for LNG shipment under pertinent national and international regulations, by which is generally meant that commercial spherical tanks have been shown by analytical calculations to leak before failing. Current regulations require only a partial secondary barrier, known as a drip tray, for Type B tanks. Spherical tanks, while attractive for fluid storage from the standpoint of maximizing volume-to-surface ratio and from the standpoint of equalizing stresses over the surface, have serious drawbacks as cargo tanks. They have a wall that is sufficiently strong to withstand hydrostatic pressure, which adds weight and increases cost. Spherical tanks typically have a wall thickness in the range of 30–60 mm. Their shape does not match the shape of a ship. Upper portions of the tanks extend approximately 15 m above the main deck. This raises the ship's center of gravity, increases vulnerability to wind effects, and requires a considerably elevated aft bridge to provide visibility over the tanks. To permit loading from the top, as is required by regulation, considerable access structure must be added above deck—ladders, catwalks, and piping, for example. Operation in high latitudes under winter conditions may be dangerous due to icing high above the deck. Spheres themselves are not free-standing, and so free-standing spherical tanks include a significant support system. Thus, while called "free-standing," in reality spherical tanks are only free-standing if one includes the support system.

Prismatic tanks avoid some drawbacks of spherical tanks. By "prismatic" we mean tanks that are shaped to follow the contours of a ship's hull. Amidship the tanks may be in the shape of rectangular solids, with six flat sides (four vertical sides, a top side, or top, and a bottom side, or bottom) and with fore and aft vertical sides, or ends, equal. They may also have flat sides that flare outwardly to better match the hull. In other words, the footprint of the tank top and tank bottom need not be of equal size. As used herein, the term, "vertical sides" includes such flared sides. Forward tanks may have a footprint in the nature of a prismatic section (or one-half of a prismatic section, if tanks extend only half way across a ship, in a side-by-side arrangement), with a forward end narrower than the aft end. Aft tanks may also have a footprint in the nature of a prismatic section.

Free-standing prismatic tanks make more efficient use of below-deck volume than do spherical tanks. They avoid high above-deck structure and the associated drawbacks of high center of gravity, wind effects and icing, and consequently have found application in high latitudes such as Alaska. Newer commercial tanks of this type have been shown analytically to meet Type B regulations. However, they contribute significantly to weight and cost due to the fact that free-standing prismatic tanks include heavy plates and a considerable amount of bracing to keep the plates from distorting under hydrostatic load. Prismatic tanks are less efficient than spherical tanks with respect to minimizing surface-to-volume ratio and equalizing hydrostatic load.

Free-standing designs, whether spherical or prismatic, can utilize insulation that, at least for the most part, need not be load-bearing.

Prismatic membrane tanks are also known. Membrane tanks do not satisfy Type B requirements and by regulation require a full secondary barrier. They are not free-standing. For an LNG cargo ship, which is of double-hull construction, such tanks are supported by the inner hull of a vessel. In addition to the hull sides and bottom, which must be of double construction for all LNG ships, membrane tanks require double main deck structure and double transverse bulkheads. Membrane tanks may be much lighter than free-standing tanks. However, they must be connected to the hull and interior bulkheads at virtually all points by load-bearing insulation. This has serious drawbacks, including primarily difficulty (and cost) of installation and elimination of access to the inside of the inner hull, the secondary barrier and the insulation for inspection, maintenance and repair. When a crack develops in the inner hull, sea water ballast reaches the insulation, with deleterious effects, and may in some cases collapse a tank wall inwardly. The inner hull can only be inspected and repaired from between the hulls, because access from the cargo area is denied. Access to the insulation, secondary barrier and outer surface of an LNG tank for inspection and repair is effectively precluded.

Existing LNG containment systems trade off at least one serious drawback for another. Free-standing tanks, both spherical and prismatic, while providing needed access to the containment system and hull, require plates that are thick, heavy and expensive. Prismatic tanks require extensive bracing, and spherical tanks have additional drawbacks discussed above. Prismatic membrane tanks, while avoiding some drawbacks of free-standing tanks, particularly in weight and material cost, incur the drawback of lack of access to the interior of a ship's inner hull and the exterior of a tank's insulation and secondary barrier, as well as the drawback of high installation cost.

An aspect of the present invention is an LNG cargo tank that avoids the weight and cost drawbacks of free-standing prismatic tanks, without incurring the weight, cost, center-of-gravity and related problems of spherical tanks, while providing greatly improved access to inner hull and tank exterior denied by membrane tanks.

Another aspect of the present invention is a light-weight LNG cargo tank that avoids the installation and access difficulties of membrane tanks while achieving the weight and cost reduction benefits of membrane tanks.

Another aspect of the present invention is a lightweight prismatic LNG cargo tank that is not free-standing and nonetheless affords greatly improved access between a support structure and the tank exterior, and further does not require a full secondary barrier, nor load-bearing insulation over the entire surface of the tank as required for a membrane tank.

SUMMARY OF THE INVENTION

This invention includes a prismatic tank and bearing system that we refer to as a semi-membrane construction and that is suitable for storage and transport of liquids. The prismatic tank may be insulated to form a low-temperature containment system suitable for LNG and other low-temperature applications. Thus, this invention includes a prismatic, LNG containment system comprising a membrane cargo tank that includes insulated walls that are not in intimate contact with a supporting structure such as the inner hull of a ship. The invention provides a generally planar membrane wall construction that requires only spatially occasional support and, hence, can be spaced from a ship's hull or other supporting structure by a system of girders that provide human access for installation, inspection, maintenance and repair. The wall construction and bracing system can be used for all six sides of a prismatic tank, or they can be used for fewer than all sides, including at least the four vertical sides.

A wall according to this invention is a continuous wall comprised, for example, of a series of these plates joined (as by welding) edge-to-edge. A wall constructed according to this invention, while generally planar, is not a flat wall comprising a continuous flat plate, which results when a series of flat plates are welded together to form a prismatic tank of known free-standing or known membrane design. Rather, a wall constructed according to this invention comprises a series of long, outwardly curved sections, each of which in our presently preferred embodiment is an arcuate portion of a cylinder. By "outwardly curved" we mean concave when viewed from the inside of the tank and, conversely, convex when viewed from the outside of the tank. The curves may be constant radius, in which case the plates are long cylindrical sections. The curves need not be constant radius, however. They may, for example, be ellipsoidal. The long, curved sections may extend vertically or horizontally, although we prefer that they extend horizontally, as in the Example described below. When the long, curved sections extend horizontally, the curvature of the sections has a horizontal axis of rotation, or in the case ellipsoidal curvature, horizontal axes of rotation.

The sections are characterized herein by reference to chord length and number of degrees of arc. Chord length applies to curved sections generally, not just cylindrical sections. Degrees of arc herein refer to cylindrical sections. Adjacent curved sections may abut one another directly, or they may be separated by narrow flat sections or narrow sections of opposite curvature, as in a corrugated wall. Our presently preferred construction is a series of abutting cylindrical sections. A wall according to this invention is not free-standing but neither is it membranous, because it requires support only occasionally across its surface. For that reason we refer to it as a semi-membrane wall construction.

The tank or, if insulated, the containment system is supported by, but removed from, a support structure, for example, a ship's hull, by a bracing system comprising parallel girders running the length of the long, straight edges of the curved sections. On one side the girders inwardly support and preferably are connected to those edges. If the tank is insulated, connection is by means of load-bearing insulation. On the opposite side the girders are attached to an inner ship hull or other support structure. The girders are sufficiently wide to provide sufficient space between the insulated tank containment system and the hull or other support structure to permit human access. Preferably the girders are at least 450 mm wide and more preferably at least 60 mm. In our preferred embodiment wherein the long, curved sections are horizontally disposed, the support girders form access walkways through the space between the tank and the inner hull or other support structure. Between girders, insulation that is not load bearing suffices.

A wall according to this invention comprises junctions between curved sections. If the wall comprises outwardly curved sections that directly abut one another, the junctions are cusps, and the girders extend along cusps formed between curved sections. If the wall comprises outwardly curved sections separated by narrow flat sections or narrow sections of reverse curvature, the junctions comprise those narrow sections, and the girders extend along those narrow sections. If the junctions comprise narrow flat sections, it is required that the girders support substantially the full narrow width of those sections so that any unsupported edge will not bend under the stresses encountered, as any unsupported flat section is an area subject to bending. Between girders the wall is curved.

BRIEF DESCRIPTION OF THE DRAWINGS

One embodiment, our presently preferred embodiment, of the invention is more particularly described in the accompanying drawings.

Figure 1:
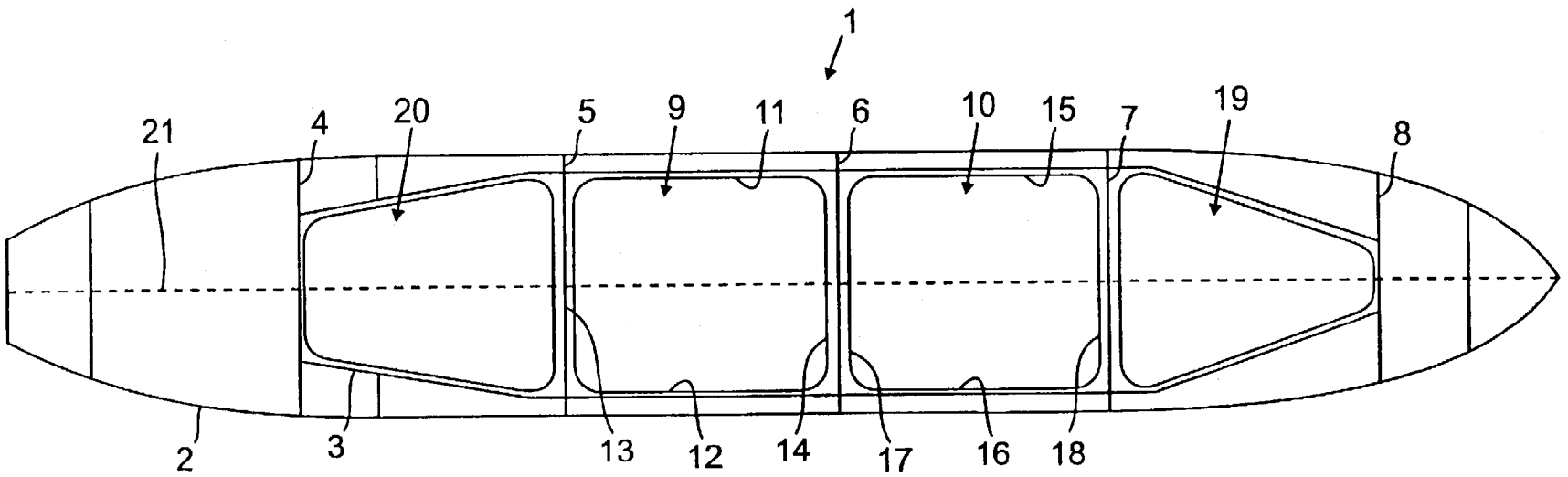
FIG. 1 is a plan view of a double-hull LNG vessel showing a typical arrangement of prismatic LNG tanks within the vessel's cargo holds.

In a preferred embodiment of the invention, the prismatic cargo tank is comprised of two types of wall structure. The top and bottom plating is flat and transmits hydrostatic load loads directly to load-bearing insulation and the adjacent ship structure. The tank vertical sides, whether truly vertical or flared, are constructed of welded plates forming slightly curved sections comprising of a series of identical horizontally disposed, long cylindrical sections whose long edges intersect one to the other at horizontal cusps all lying in a common vertical plane and extending horizontally across the length of the side.

The radius of curvature of our presently preferred design of slightly curved sections is 4.445 m, and the chord length is 2.75 m. Both can be varied considerably, depending on design requirements, cost and availability of materials, and construction cost rates. Plate and curved section design generally is an economic balance for a particular tank. As the chord length and radius of curvature are increased, plates of a given material must increase in thickness, but the amount of plate welding may well be reduced. To provide human access, the chord length should be a minimum of 1.2 m, preferably at least 1.8 m and most preferably 2.4 to 3.6 m. The maximum chord length may exceed 3.6 m in certain cases, such as 4.5 m or even more. For a given chord length, decreasing the radius of curvature increases the number of degrees of arc the plate must include. Geometrical considerations set an upper limit of 180 degrees, a semicircle. Zero degrees, on the other hand, would be a flat section. Neither limit is acceptable. The sections are best described as "slightly curved," by which we mean neither essentially flat nor approaching a semicircle, but rather in the range of 10–60 degrees, preferably 15–45 degrees. Persons skilled in the art are able to calculate required plate thickness and hence to perform an economic balance to choose a design for a particular application.

It is to be understood that what we refer to as a single curved section may be a single plate, part of a single plate, multiple plates formed together or parts of multiple plates joined together. For example, a cylindrical plate approximately 12 m long may be made by welding together two sections half that length. Also, the desired arc length may be achieved by welding together two sections of half that arc length. Our presently preferred design includes plates pressed to form one-half of each of two adjacent curved sections, with welds between plates extending along the midline of the arc of a section.

Vertical edges formed by the intersection of two vertical sides possibly may be formed by mitering the sections of each side and welding the sides directly. To permit thermal movement without undue stress, the tank should be generally flexible. To that end we prefer that intersecting vertical sides may be joined together with vertical curved edge sections. Our presently preferred construction uses vertical cylindrical sections to join intersecting sides. The horizontal upper and lower edges of the vertical sides are similarly joined to the top and bottom. The eight corners formed by the intersecting wall edges may be a mitered fit with welding, whether or not curved edge plates are used. Alternatively, generally spherical corner sections may be used.

As stated above, the curved-section walls according to this invention are neither free-standing nor truly membranous. They must be supported, but only between or at the cusps formed by the junction of outwardly curved sections. For simplicity the bracing system will be described with reference to cusps formed by abutting curved sections. The bracing system comprises girders that extend lengthwise along the cusps and laterally connect the support structure to the tank wall at the cusps. If the tank is insulated, as for LNG or other low-temperature applications, the bracing system includes load-bearing insulation blocks fitted along the cusps. We prefer that multiple blocks, rather than a single continuous block, be used to allow for differential thermal expansion. These blocks are aligned with corresponding girders fitted to the inner surface of the support structure, for example, the inner hull of the vessel's cargo hold and transverse bulkheads. The girders may be segmented so as not to transmit ship loads to cargo tank. Cargo pressure loads are transmitted through this arrangement to the support structure. The walls are unsupported between cusps. The large majority of the outer surface of the sides so constructed may be insulated with non-load-bearing insulation, that is, in all areas where there is no load-bearing insulation block. The insulated tank containment system of this invention permits at least the vertical sides, and optionally the top and bottom as well, to be located at a sufficient distance from the support structure, typically an inner hull surface and transverse bulkhead, to provide access space to facilitate construction and to permit inspection, maintenance and repair of the insulation, the bracing system and the inner surface of the support structure. The advantages of this feature will be readily apparent to those skilled in design, construction, operation and maintenance of LNG containment systems for vessels.

An alternative embodiment of the invention employs similarly curved-section structure for either or both of the top or bottom sides of the tank in lieu of the flat plate structure in our presently preferred embodiment. Other alternative embodiments may employ a free-standing top, for example, stiffened flat-plate construction. In all cases the vertical sides remain as previously described. Use of curved-section construction according to this invention for the top or bottom allows for separation of that side from the adjacent support structure, with attendant construction and inspection advantages.

The axis of orientation for long curved sections and cusps making up the vertical sides of the tank may be vertical rather than horizontal. In such embodiments all other features would be similar to those described for the typical application except that the orientation of the load bearing insulation blocks between sections and the corresponding girders attached to the inner hull structure would also be vertical to coincide with the vertical intersections of the adjacent arcs making up the curved sections. Horizontal walkways and passages through the vertically oriented girders can be added.

A tank or containment system according to this invention may be installed in a support structure with or without pre-stressing at ambient temperature. The design must make sure that stresses do not exceed allowable design values at ambient (warm) temperatures and under service (very cool for LNG) temperatures and loads. Pre-stressing is accomplished by installing the tank within a support structure, such as in a vessel cargo hold, in a pre-stressed condition at ambient temperatures. The objective for pre-stressing is to have the tank vertical sides and top close to or in the respective locations they will assume when in the low temperature service condition so that the tanks will be a near stress-free condition when they are at service temperature, but are empty. Pre-stressing can be accomplished in a number of ways. One method is to arrange the load-bearing blocks on the sides of the tank so that they can be adjusted in conjunction with physical jacking-in of the sides and then be fixed in position to hold the cusps in the position they will assume in the cold, empty state. A similar procedure may be employed for a top structure of flat design to jack it down into the cold position and to adjust the load bearing insulation to hold it in that position. The jacking process will induce stresses in the structure at ambient conditions; these stresses, however, will be relieved as the tank shrinks as it is cooled down to the service temperature. Stresses and thermal contraction are readily calculable so as to assure the desired objective. A second method of pre-stressing is to cool the tank with liquid nitrogen during installation in the vessel's cargo hold and to adjust the load-bearing insulation blocks on the curved plate sides, and load-bearing insulation of a flat top, if used, to a tight fit with the tank in the cooled condition. After the bracing system is fixed with the tank cooled, the tank will assume a pre-stressed state as it warms to ambient temperature, similar to the state achieved by the jacking method.

This LNG containment system and bracing system, while developed primarily for shipboard carriage of LNG cargos, is suitable for the storage or carriage of any refrigerated liquid, whether in shore-based or shipboard applications. The tank construction and bracing system without insulation can also be used for tanks designed to contain or carry other liquids which, because of their special characteristics, i.e. temperature, corrosive properties or purity requirements, cannot be carried in direct contact with normal steel structures.

Advantages of the containment system and bracing system according to this invention compared to the traditional free-standing prismatic tank containment systems for LNG cargo tanks include:

a) greatly reduced weight of high-cost tank material, simplification of tank structure, with corresponding reductions in welding and construction labor man hours; and b) simplification of basic hull structure, with corresponding reduction in material, welding and construction labor man hours.

The advantages compared to the traditional prismatic membrane containment systems for LNG cargo tanks are:

a) use of moderate quantities of lower cost materials for the tank and simpler low-cost insulation materials with substantial reduction in welding and corresponding reduction in construction labor man hours;

b) construction of principal elements of the containment system separate from and independent of the construction for the basic hull structure with resulting improvement of the overall construction sequence and corresponding reduction in costs; and c) physical separation of at least the vertical sides of the containment system from the surrounding hull structure with corresponding simplification of the construction process and reduced construction labor man hours and ease of access between the containment system and the basic hull structure to facilitate inspection, maintenance and repair of both the containment system and the surrounding hull structure with corresponding reduction in operating and maintenance costs.

EXAMPLE

The wall structure and support system will now be described in reference to our preferred embodiment, which is an insulated LNG cargo tank that relies on the inner hull of a double-hulled ship for support. Our presently preferred design is a prismatic LNG cargo tank having a flat membrane bottom, a flat membrane top, and semi-membrane vertical sides comprising a series of horizontally disposed, long, slightly curved plates. It will be described with reference to our current design, which is for an LNG ship having a total cargo capacity of 137,500 cubic meters.

FIG. 1 is a plan view of a typical double hull LNG vessel 1. Ship 1 includes outer hull 2 and inner hull 3. Within ship 1 are cargo holds. Our current design is for four cargo holds separated from each other and from bow and stern regions by transverse bulkheads 4, 5, 6, 7, 8. The two center cargo holds, between bulkhead 5 and 6 and between bulkheads 6 and 7, are rectangular in footprint. The fore and aft cargo holds, between bulkheads 4 and 5 and between bulkheads 7 and 8, are tapered. In this example the lengths of the four cargo holds are approximately equal.

Within each cargo hold is a prismatic containment system according to this invention. Each containment system includes an insulated prismatic tank (the center tanks are termed "prismatic" even though opposed sides are of equal length) spaced from inner hull 3 and adjacent bulkheads. Center tank 9 includes vertical sides 11, 12, 13, 14 (we sometimes refer to sides 13, 14, as "ends"), and center tank 10 includes vertical sides 15, 16, 17, 18. Fore and aft tanks 19, 20 are tapered to accommodate the vessel's ship-shape towards the ends.

Figure 2:
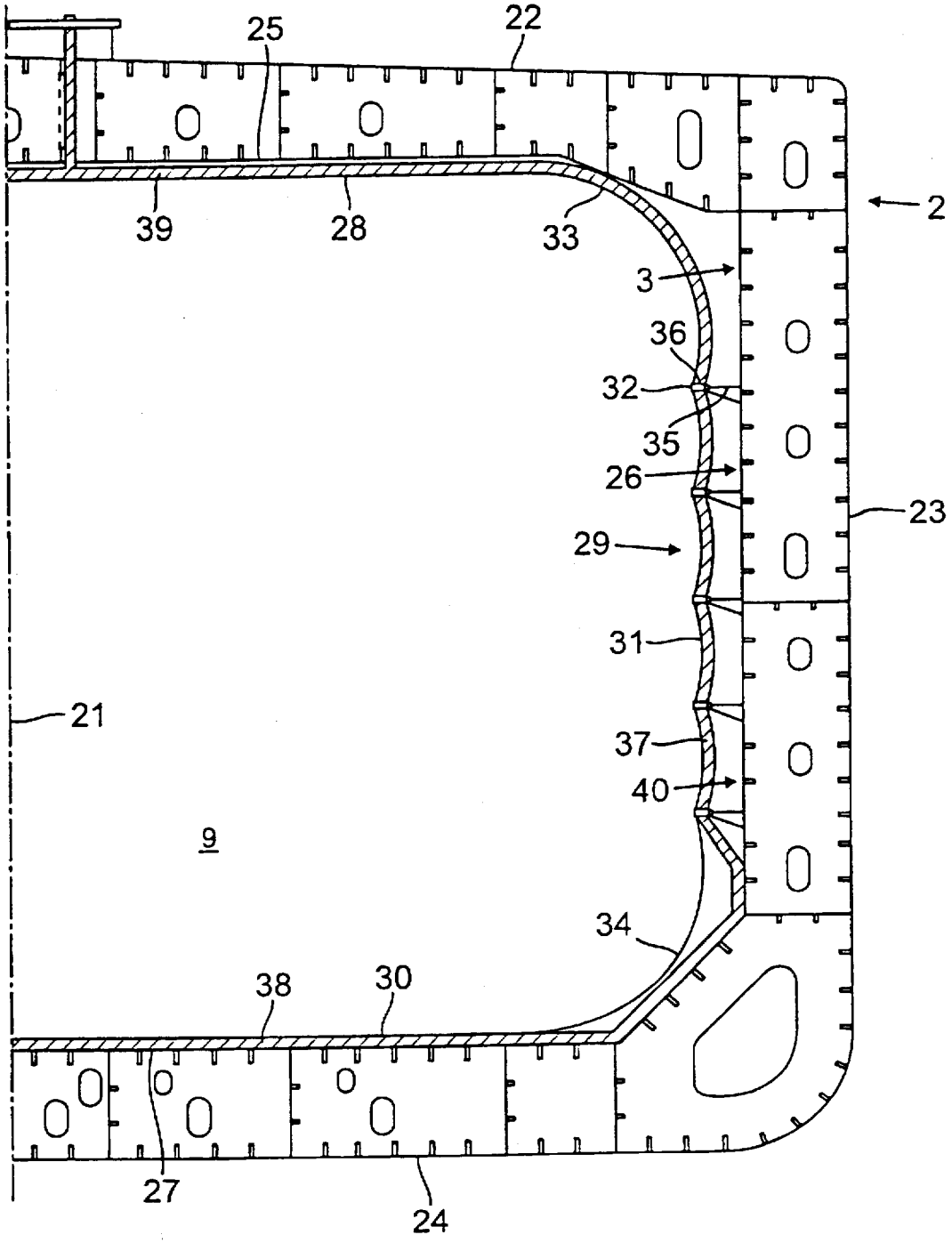
FIG. 2 is a partial midship section of a double-hull LNG vessel such as shown in FIG. 1 showing a cross section of one side of the hull and one side of the ship-wide containment system and bracing system.

FIG. 2 is a partial midship section of double-hulled vessel 1 from center line 21 (FIG. 1) to outer hull 2 through center tank 9. Outer hull 2 comprises upper hull structure 22, side hull structure 23 and bottom hull structure 24 inner hull 3 comprises upper hull structure 25, side hull structure 26 and bottom hull structure 27. Inner hull 3 supports lightweight insulated tank 9 which comprises of a flat metal top 28, metal side 29 of curved-plate construction according to this invention, and flat metal bottom 30. In this example all six sides are constructed from aluminum plates. The top plates are 7 mm thick. The bottom plates are 18 mm thick. The plates in the vertical sides vary in thickness from 12 to 16 mm.

Vertical side 29 is made up a series of curved sections 31. In this example, each section 31 is an horizontally disposed, long cylindrical section having a chord of 2.75 m and radius of curvature of 4.445 m. Adjoining sections 31 abut along cusps 32. Side 29 is joined to top 28 by curved edge section 33, which is an horizontally disposed, long cylindrical section having an arc of greater than ninety degrees (the arc is ninety degrees plus one-half the arc of a section 31) but the same radius of curvature as the sections 31. Side 29 is joined to bottom 30 by curved edge section 34, which is configured and disposed similarly to section 33.

Figure 4:
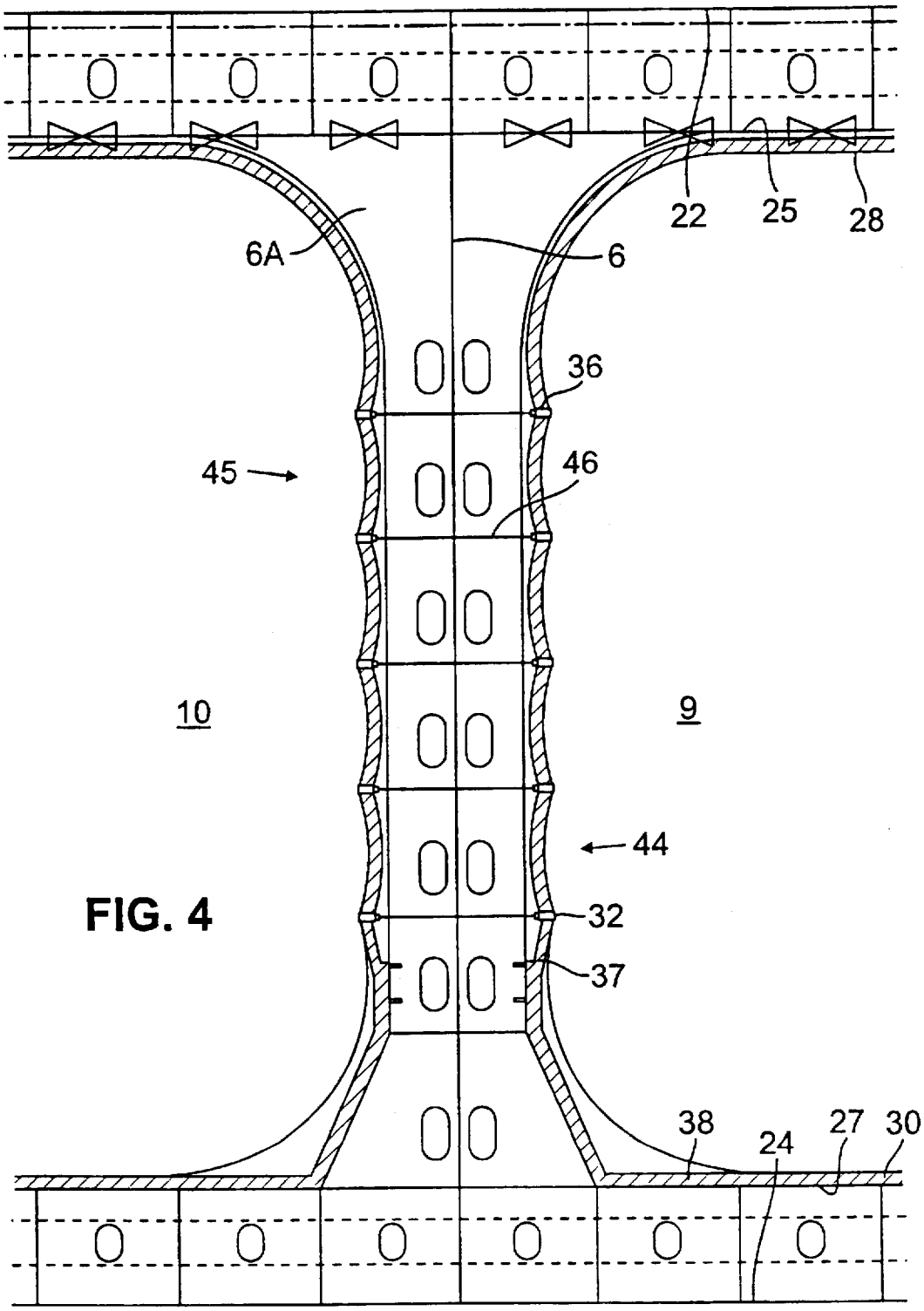
FIG. 4 is a partial cross section of a transverse bulkhead between two cargo holds of an LNG vessel according to FIG. 1 showing the ends of the containment system shown in FIG. 2 and the end wall of an adjacent containment system in relation to a transverse bulkhead.

Side 29 is made up of a series of individual plates welded together. Our presently preferred design utilizes plates that are pressed or extruded into a "bird-wing" shape, that is, plates extending vertically above and below a cusp 32 by one-half of the arc of a curved section. Referring to FIG. 4, a single side plate extends vertically from 32*a*, the midpoint of one curved section to 32*b*, the midpoint of the next curved section, and includes one cusp 32 at the midpoint of the plate. As has been indicated, joints are welded, in this case at plate edges 32*a* and 32*b*.

In our current design, plates in the vertical sides are progressively lighter weight proceeding from the bottom to the top of the tank. Naval architects and marine engineers can calculate the required thickness of any plate of a given material to achieve acceptable stress levels taking into account the specific gravity of the cargo, dynamic load characteristics, geometry, thermal coefficients and restraint on the tank. In our current design described in this example, the tanks are approximately 21 m tall. As indicated above, the plates are about 2.75 m wide (vertical direction). The lowest plates are 16 mm thick. The highest plates are 12 mm thick. Intermediate plates are of intermediate thickness. The plates in bottom edge section 34 are 18 mm thick. The plates in top edge section 33 are 11 mm thick.

The following description of our current design includes values for plate thicknesses. Those values have been arrived at through application of the rules of construction found in the Rules for Building and Classing Steel Vessels, Section 24: Rules for Building and Classing Vessels Intended for Liquified Gases and Chemical Cargoes in Bulk, published by the American Bureau of Shipping. Because of the novelty of our design, we consider thicknesses derived from these traditional rules to be approximate. For construction of a commercial embodiment, refined thickness values obtained by finite element analysis will be used.

As shown in FIG. 2, vertical side 29 is spaced from inner hull side 26. It is supported by inner hull side 26 by horizontally extending girders 35, which are attached to inner hull side 26 and which connect inner hull side 26 to load-bearing insulation blocks 36 disposed along cusps 32 at the junctures of sections 31. In our current design girders 35 provide a minimum separation between the containment system and the inner hull of 750 mm. Pressure loads on vertical tank side 29 are transmitted to inner hull side 26 through blocks 36 and girders 35. Except where there are blocks 36, sections 31 are covered with insulation 37 that is not load-bearing. Girders 35 are continuous between bulkheads.

Tank bottom 30 is supported by inner hull bottom 27, and separated therefrom, by load-bearing insulation 38. Tank top 28 is inwardly supported by inner hull top 25, and separated therefrom, by load-bearing insulation 39. Load-bearing insulation 38 is extended beyond bottom 30 to insulate and support bottom edge section 34. It is spaced therefrom to permit installation of a drip tray (not shown). Top edge section 33 is insulated with insulation 37 that is not load-bearing, except where it joins top 28 and the uppermost curved section 31 of vertical side 29.

Between tank side 29 and hull side 26 is a space 40 through which horizontal girders 35 extend. Horizontal girders 35, which are separated in our preferred embodiment by about 2.75 vertical meters, provide walkways through space 40 for inspection, maintenance and repair. Space 40 also provides access during installation of the tank, including pre-stressing side 29, as will be described.

Either or both of top 28 and bottom 30 of LNG tank 29 can be constructed similarly to side 29 if desired. If so constructed, top 28 and bottom 30 can be suspended away from the inner hull, as FIG. 2 shows for side 29.

Figure 3:
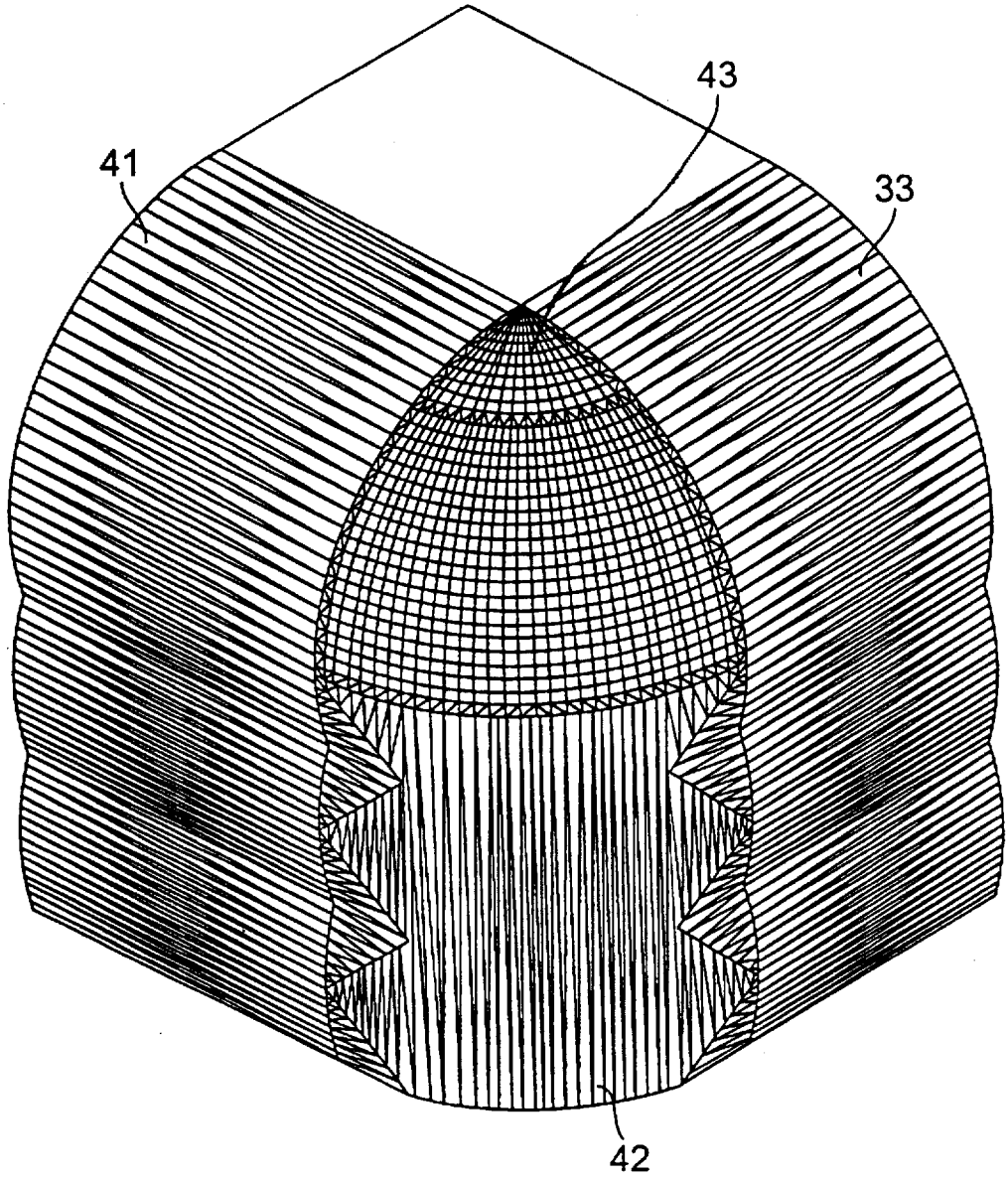
FIG. 3 is a simplified perspective of a spherical-section corner construction for the containment system shown in FIGS. 1 and 2.

FIG. 3 shows, in simplified perspective, construction of a corner of tank 9. Top edge section 33 of side 29 (FIG. 2), perpendicular top edge section 41 and vertical edge section 42 meet to form a corner. Top edge section 41 is similar to top edge section 33 except for length. Vertical edge section 42 is similarly curved, that is, a cylindrical section of the required arc but with its vertical edges scalloped to follow the contours of wall section 31. The thickness of Section 42 varies from 16 mm at the bottom to 14 mm at top, where it meets section 43. As earlier stated, the three edge sections could be shaped to form a sealed corner at their junctures. We presently prefer, however, to use a spherically curved section 43 to make the corner, joining the three edge sections 33, 41 and 42. Because corners are locations of stress concentration, it is desired that section 43 be as flexible as possible. Spherical section 43 has the same radius of curvature as wall sections 31. The plates in spherical section 43 are 7 mm thick. The corresponding bottom corners (not shown) are also spherical sections, but the bottom spherical sections are 9 mm thick.

FIG. 4 is a partial cross section of transverse bulkhead 6 and its intermittent support structure 6A between two cargo holds showing cross section of the adjacent vertical sides, or ends, of semi-membrane LNG tank 9 and adjacent tank 10 (FIG. 1). The tank ends are constructed in a similar manner to that shown for the side 29 in FIG. 2. They will be described with reference to tank 9. FIG. 4 shows portions of top 22 and bottom 24 of outer hull 2, and top 25 and bottom 27 of inner hull 3; portions of top 28 and bottom 30 of tank 9, vertical end or side 44 of tank 9, and transverse bulkhead 6, which supports end 44. As indicated, FIG. 4 also shows a portion of tank 10 on the opposite side of transverse bulkhead 6. End wall 45 is a mirror image of end wall 44. End vertical wall 44 is constructed similarly to side 29 shown in FIG. 2. It is supported by bulkhead 6 as side 29 is supported by inner hull vertical side 26. Structural girders 46 are connected to cusps 32 by load-bearing insulation blocks 36 and are connected to bulkhead 6. Structural girders 46 are similar to, and abut, structural girders 35 shown in FIG. 2 and perform the same functions in addition to providing structural rigidity for the transverse bulkhead.

Figure 5:
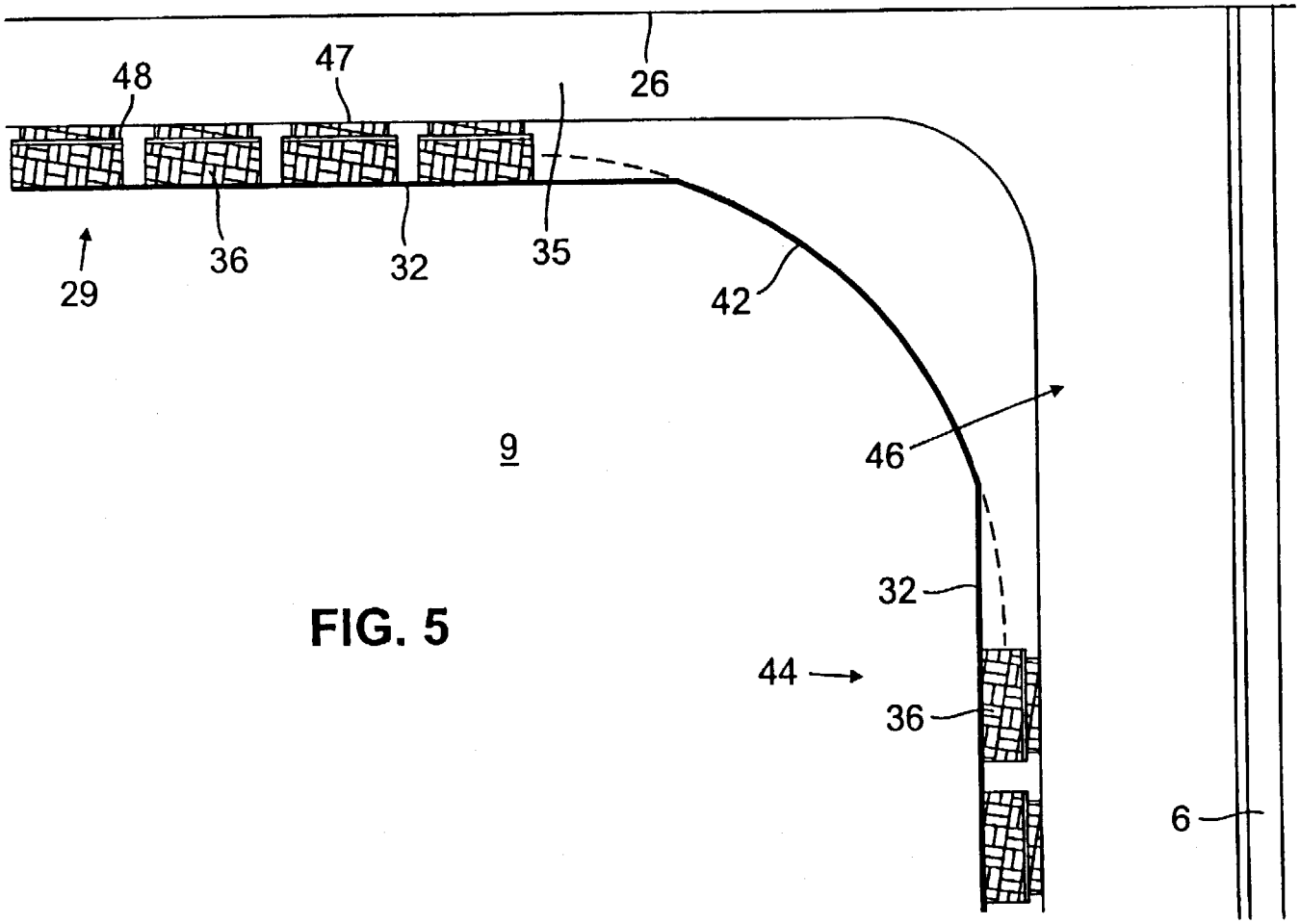
FIG. 5 is a plan section of the containment system of FIGS. 2–4 at the level of one cusp between curved sections, showing the bracing system of load-bearing insulation blocks and girders supporting a tank side wall from the hull and supporting an adjacent end wall from a transverse bulkhead.

FIG. 5 is a detail sectional plan view at the level of one cusp 32, near the junction of bulkhead 6 with inner hull side 26. FIG. 5 shows a portion of tank 9, including vertical side wall 29, vertical end wall 44, with vertical edge section 42 joining them. The view is along a cusp 32 on both the side and end walls. Side wall 29 is supported by inner hull side 26 by horizontal girder 35 and load bearing insulation blocks 36, as has been described in connection with FIG. 2. End wall 44 is similarly supported by transverse bulkhead 6 by horizontal girder 46 and insulation blocks 36, as has been described in connection with FIG. 4. As shown in FIG. 5, girders 35 and 46 form a continuous walkway.

Load-bearing blocks 36 are spaced intermittently along cusps 32 to allow for horizontal movement of the blocks along their long axes due to the differential in coefficients of thermal expansion of the blocks and the cargo tank 9. One suitable load-bearing insulation material used in LNG ships is a phenolic laminate marketed under the name "Lamiper" and available from Permali. The space between blocks 36 is insulation that is not load-bearing (not shown). Adjusting wedges 47 are in line with each load-bearing block 36, between the block and corresponding girder 35 or 46. Blocks 36 extend in length greater than wedges 47 to provide shoulder locations 48 for placing jacking devices that may be used to pre-stress the cargo tanks, if desired.

Figure 6:
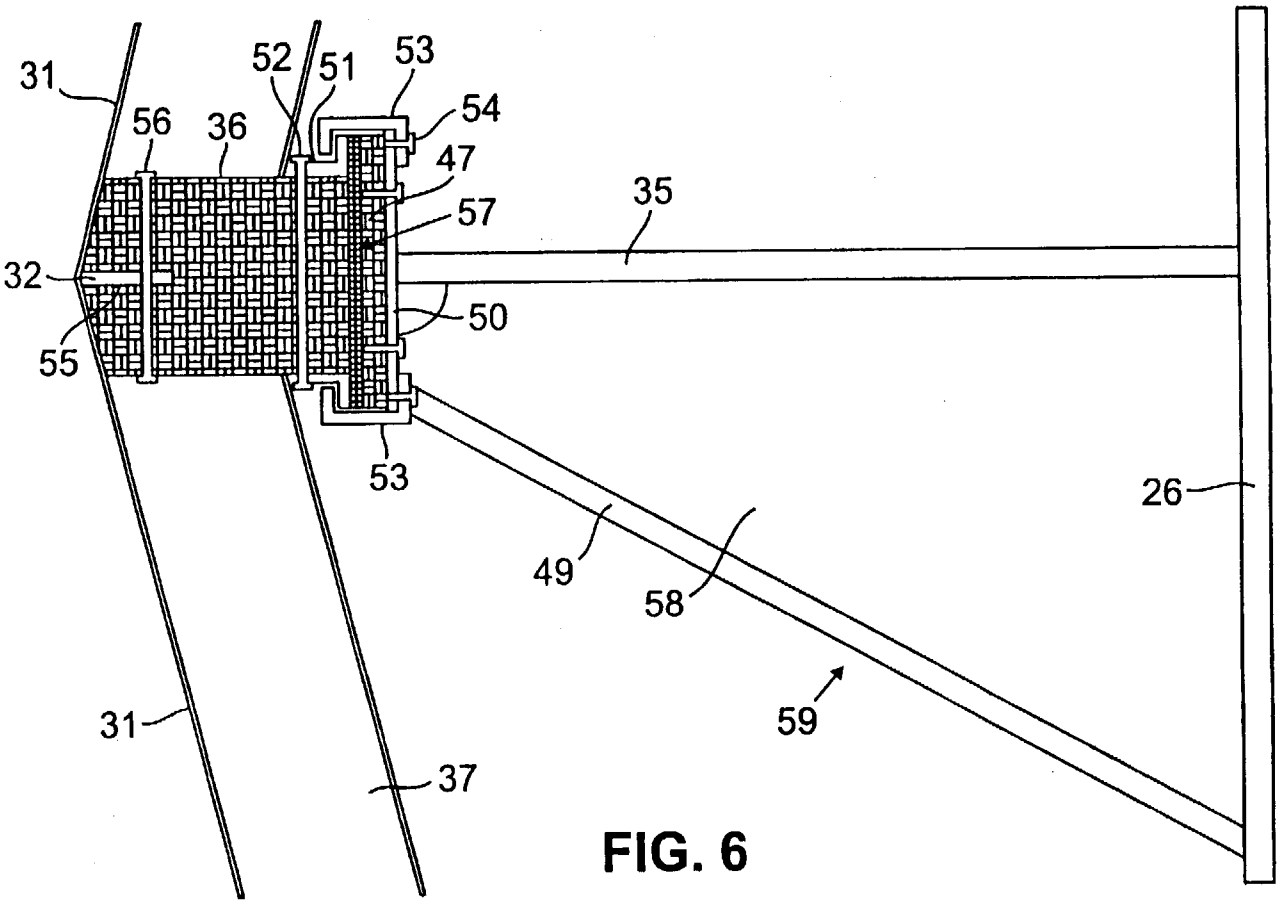
FIG. 6 is a detail cross section of the bracing system shown in FIG. 5, including a load-bearing insulation block and horizontal girder.

FIG. 6 is a detail cross section showing one possible bracing system through one load-bearing block 36 connecting side 29 of tank 9 to inner hull side 26 though structural girder 35 (FIG. 2). FIG. 6 shows portions of two sections 31 in the region of a cusp 32. In the embodiment described here the wall portion shown comprises a single plate. Load-bearing insulation block 36 is shaped to fit into the region of cusp 32.

Adjusting wedge 47 is shown in place between block 36 and girder 35. Structural girder (and walkway) 35 connects block 36, and hence adjacent sections 31 to inner hull side 26, which thereby supports tank 9. Bracket 59 helps support girder 35. Bracket 59 comprises brace plate 49 and face plate 58. Structural girder 35 includes vertical flange 50 to engage block 36. Steel angles 51 are mounted on block 36 and secured by bolt 52. Secured to flange 50 are extended U-shaped members 53, which engage angles 51 and prevent nonaligned vertical movement of block 36 and adjusting wedge 47, which is secured to flange 50 by screws 54. Block 36 is attached to the cargo tank 9 using a welded tab 55 extending from the tank and threaded bolt. A liner 57 of low friction material is fitted between the matching surfaces of the load bearing block 36 and the adjusting wedge 47 to facilitate the permitted horizontal movement.

Figure 7:
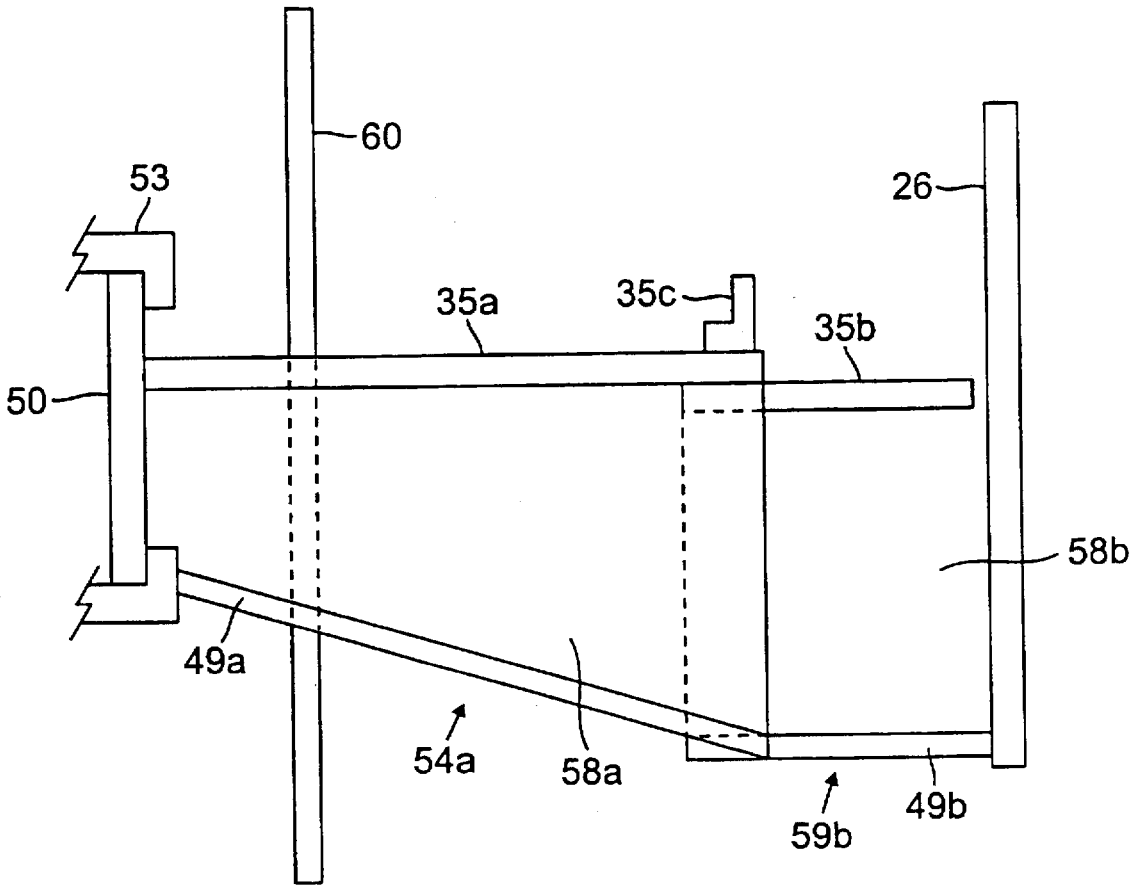
FIG. 7 is a detail cross section of a modification of the bracing system shown in FIGS. 5–6.

A modification of the bracing system design of FIG. 6 is shown in FIG. 7, which shows the portion of the system of FIG. 6 from flange 50 to inner hull 26. In this modification, the support girder comprises two parts, portion **35*a* attached to flange 50 and portion 35*b* attached to inner hull side 26. In this design wedge 47 (FIG. 6) is of fixed thickness and is not utilized as an adjusting wedge. Girder portion 35*a* is fitted with jacking flange 35*c*. Girder portion 35*a* overlaps and is supported by girder portion 35*b*. In this design the support bracket also comprises two parts, portion 59*a* attached to flange 50 and portion 59*b* attached to inner hull side 26. Portion 59*a* comprises brace plate 49*a* and face plate 58*a*. Portion 59*b* comprises brace plate 49*b* and face plate 58*b*. Bracket portions 59*a* and 59*b*** overlap one another.

Referring to first FIGS. 5 and 6, our preferred method of installation in a pre-stressed condition will be described. As has been described, wall 29 may be installed in a pre-stressed state to minimize stress during operation, that is, under hydrostatic load at low temperature. It is well known how to calculate how much inward deformation is required at ambient temperature to bring a cusp 32 to the position it would otherwise achieve when tank 9 is cooled to a temperature.

Our preferred method of pre-stressing involves placing jacks between structural girders 35, 46 and corresponding load-bearing insulation blocks 36. Exposed shoulders 48 on blocks 36 (FIG. 5) permit installation of jacks. Blocks 36 are jacked inwardly to deform plates 31 by the calculated amount. Then adjusting wedges 47 are inserted and secured with screws (FIG. 6). Low friction liner 57 eases insertion of wedges 47 and thereafter aids permitted horizontal movement, as discussed above. When wedges 47 are in place, jacks are removed.

The alternative bracing system also shown in FIG. 7 permits jacking in a similar fashion, except jacks are placed on flange **35*c*. After jacking, girder portions 35*a* and 35*b* are welded to one another, as are brace plates 49*a* and 49*b* and face plates 58*a* and 58*b*. Other embodiments will be readily apparent, such as using narrow girder portions 35*a*, 35*b***, which do not overlap, and adding a bridging girder portion spanning the gap between them after the tank is in place.

Tanks according to this invention can be constructed in place within a support structure or, preferably, constructed outside the support structure and slid or lowered into place, for example, into a ship's cargo hold. Riggers can construct suitable rigging devices or fixtures for lifting and lowering a tank. If necessary or desired for particular embodiments, internal support structure can be placed in the tank to minimize the complexity of external rigging fixtures.

The modified bracing system shown in FIG. 7 can be used for external support for moving a tank. The portion of the bracing system attached to flange 50, including girder portion **35*a* and bracket portion 59*a*, are installed on the tank for this purpose. In addition a plurality of vertical beams 60 are added to stabilize the structure. A further modification is to use progressively wider girder portion 35*a* proceeding up the tank in stepwise fashion. This modification maximizes clearance between girder portions 35*a* and girder portions 35*b*, which are progressively narrower proceeding up hull side 26, if girder portions 35*b* and bracket portions 59*b*** are installed before the tank is lowered into the support structure.

As previously indicated a typical LNG cargo vessel has a cargo capacity of about 137,000 cubic meters. We estimate the cost of a vessel of that capacity to be about $250 million with constructions known in the art, that is, spherical, stand-alone prismatic or membrane prismatic. We estimate a cost savings of greater than 15% using a semi-membrane construction according to this invention. Cost savings are primarily in the tanks and their installation rather than in the ship itself. For example, whereas a spherical tank may require a wall thickness in the range of 30 to 60 mm, our preferred design requires plate thickness ranging from 6–18 mm, depending on the calculated stress (corners, for example, are locations of high stress) and hydrostatic load (lower plates are subjected to a higher load than are higher plates).

The Example described in connection with the FIGURES, while our presently preferred construction, is provided by way of illustration only. It will be appreciated by those skilled in the art that various modifications may be made in the design and construction of the containment system and of the bracing system as long as the vertical tank sidewalls comprise outwardly curved portions between girders spaced sufficiently far apart to provide space between the tank and a support structure for human access to the exterior of the tank.

We claim:

1. A semi-membrane LNG containment and bracing system disposed in a hold of a double-hulled cargo ship having an inner hull and an outer hull, said hold being defined by the inner hull and transverse bulkheads, comprising an insulated prismatic tank having a top side, a bottom side and four vertically extending semi-membrane side walls, each side wall comprising a series of long, parallel, horizontally extending, outwardly curved sections, each extending across said side and having a chord length of from 1.2 to 4.5 m, said side wall further comprising junctions between said curved sections, and a bracing system supporting said side walls from said hull and inner said transverse bulkheads, comprising horizontally extending girders supported by said hull and said bulkheads and supportingly connecting them to said sidewalls along said junctions through load-bearing insulation blocks abutting said junctions, wherein said girders have sufficient width to provide a space between said side walls, on the one hand, and said inner hull and transverse bulkheads, on the other hand, for human access to said space.

2. The containment and bracing system according to claim 1 wherein at least one of said top side and said bottom side comprises a semi-membrane construction according to claim 1, further comprising a bracing system according to claim 1 supporting said at least one side from said inner hull.

3. The system according to claim 1, wherein wall comprises abutting curved sections and said junctions are cusps.

4. The system according to claim 3 wherein said chord lengths are 2.4 to 3.6 m.

5. The system according to claim 4 wherein said curved sections are cylindrical sections.

6. The system according to claim 5 wherein said cylindrical sections comprise an arc of 15–45 degrees.

7. The system according to claim 1 wherein said wall comprises narrow plates between curved sections and said junctions are said narrow plates.

8. The system according to claim 7 wherein said chord lengths are 2.4 to 3.6 m.

9. The system according to claim 1 wherein said tank is pre-stressed at ambient temperature.

10. The system according to claim 1 wherein said tank further comprises vertically extending, outwardly curved edge sections joining adjacent vertically extending walls and horizontally extending, outwardly curved edge sections joining each vertically extending wall to said top side and each vertically extending wall to said bottom side.

11. The system according to claim 10 wherein said tank further comprises spherical corner sections.

12. A semi-membrane, prismatic liquid holding system comprising:

a vertically extending support structure capable of withstanding hydrostatic load from stored liquid;

a semi-membrane prismatic tank disposed within said support structure, said prismatic tank comprising a top side, a bottom side and four vertically extending semi-membrane sides, each vertically extending tank side comprising (a) a multiplicity of parallel outwardly curved sections extending across said side and having a chord length of from 1.2 to 4.5 m and (b) junctions between said sections; and a bracing system supportingly connecting said vertically extending sides to said support structure along said junctions.

13. The system according to claim 12 wherein said outwardly curved sections extend vertically.

14. The liquid holding system according to claim 12 wherein said bracing system includes girders parallel to said junctions.

15. The liquid holding system according to claim 14 wherein said tank is an insulated tank and said bracing system includes load-bearing insulation contacting said junctions.

16. The liquid holding system according to claim 14 wherein said support structure comprises the inner hull of a cargo ship and transverse bulkheads of said ship.

17. The liquid holding system according to claim 12 wherein at least one of said top side and said bottom side comprises a semi-membrane construction according to claim 14, further comprising a bracing system according to claim 14 supporting said at least one side from said support structure.

18. The liquid holding system according to claim 12 wherein said chord lengths are 2.4 to 3.6 m.

19. The liquid holding system according to claim 12 wherein said curved sections are cylindrical and comprise an arc of 15–45 degrees.

20. The liquid holding system according to claim 12 wherein said tank is pre-stressed at ambient temperature.

* * * * *